United States Patent [19]

Wakasono

[11] 4,266,700

[45] May 12, 1981

[54] FREELY ADJUSTABLE PIN-TUCKING DEVICE FOR USE IN A PIN TUCKING MACHINE

[75] Inventor: Shinichi Wakasono, Mugi, Japan

[73] Assignee: Vari-O-Matic Machine Corporation, Japan

[21] Appl. No.: 77,349

[22] Filed: Sep. 20, 1979

[51] Int. Cl.[3] ..... A41H 43/00

[52] U.S. Cl. ..... 223/34; 112/144

[58] Field of Search ..... 223/28–36; 112/144

[56] References Cited

U.S. PATENT DOCUMENTS

| | | | |
|---|---|---|---|
| 1,024,317 | 4/1912 | Douglas | 223/34 X |
| 2,642,828 | 6/1953 | Carroll | 112/144 |
| 2,948,241 | 8/1960 | Wyndham | 223/34 X |
| 4,079,682 | 3/1978 | Nishiwaki | 112/144 X |

*Primary Examiner*—Louis Rimrodt

*Attorney, Agent, or Firm*—Maky, Renner, Otto & Boisselle

[57] ABSTRACT

A guide board for use in guiding fabric in a pin-tucking sewing machine in which the guide members are made freely detachable and replaceable to obtain a desired pattern of pin-tucking without changing the guide board but simply removing and/or replacing the guide members.

2 Claims, 11 Drawing Figures

FREELY ADJUSTABLE PIN-TUCKING DEVICE FOR USE IN A PIN TUCKING MACHINE

BACKGROUND OF THE INVENTION (1) Field of the Invention

The present invention relates to a pin-tucking sewing machine exclusively used for providing pin-tucking. A pin-tucking sewing machine comprises a plurality of sewing needles arranged equidistantly. The fabric material or cloth is folded along a corresponding number of pin-tuck lines extending in parallel and equidistantly. Thus continuously folded pin-tucking are sewn by the plurality of needles arranged in a row extending in normal to the moving direction of the fabric material to form decorative stitch lines.

More especially, the present invention relates to the guide board used for guiding the fabric material to form the pin-tucking folds and to feed to the needle plate.

(2) Description of the Prior Art

The abovementioned pin-tucking sewing machine had been used in practice. The known pin-tucking sewing machine comprises a pair of guide boards, i.e. an upper guide board and a lower guide board. A fabric material to be worked is passed through the pair of guide boards and is folded along a number of pin-tucking lines extending in parallel and equidistantly. The fabric is continuously folded and sewn by the plurality of needles provided in a corresponding number with the stitch lines to form pin-tucking. The needles are arranged at even interval and at location the fabric material is fed out.

FIGS. 7 and 8 show a pair of such known guide boards. FIG. 7 shows an upper guide board 20 and FIG. 8 shows a lower guide board 21. The two guide boards 20 and 21 are used in stucked position with each other. Each of the guide board 20 or 21 comprises a certain number of guide members 26 extending from the surface. The guide members 26 have radially extending guide portion 25 and parallel working heads 24 extending in parallel and equidistantly. The working heads 24 terminate at the ends with tucking guide 22 or 23. In the prior art construction, the guide members 26 are fixedly mounted on the base of the guide board 20 or 21 for instance by welding.

Accordingly, in the prior art machine, the width of the tucked portion and the space thereof or the space of the stitches are uniformly decided previously by the guide boards used for the machine.

FIG. 9 shows one embodiment of the finished fabric obtained by the prior art pin-tucking sewing machine. In FIG. 9, "B" shows the fabric material to be worked and "C" is the pin-tucking. In the prior art machine, only such uniformly spaced pin-tucking has been obtained unless the guide board itself is interchanged. FIG. 9 shows in case of 12 pin-tucking obtained by 12 parallel sewing needles. In case if the width of the pin-tucking or the space therebetween is desired to be widened, the corresponding thread on the stitch once sewn must be removed after completing the even spaced pin-tucking, for instance, 12 pin-tucking. In this case, the surface of the fabric material is spoiled by the needle at which the stitch is to be removed. This spoils outer looking of the completed fabric. More especially in case if the fabric material is cotton, the stitches once sews or even folded tuckings are very difficult to be removed by ironing or the like.

SUMMARY OF THE INVENTION

The present invention has for its object to realize a pin-tucking sewing machine having a more flexibility to vary the number of the pin-tucking, width of the tuck and the arrangement such as spaces of the pin-tucking. In accordance with the present invention, the guide members of the lower guide board are made freely detachable so that the width of the pin-tucking and the spaces therebetween are made freely selectable by removing some of the guide members by pulling out the same from the lower guide board or replacing the same with one having different length.

Namely according to the present invention pin-tucking of various width and spaces can be made by using a pair of guide boards and by only removing or replacing some of the guide members from the lower guide board thereof.

The lower guide board is made of material such as metal, plastic or wood and is provided with even spaced and radially extending inserting grooves on the upper surface thereof. A separate set of guide members made of steel strip and having tucking guide at one end and radial working head of different angle to match with the radial grooves on the board are provided. The guide member further has a wide vertical inserting leg and inserting limb on the lower edge. The guide members are mounted on the lower guide board in a desired number and desired combination in the position and the length to from various pin-tucking having different width and the spaces.

DESCRIPTION OF THE PREFERRED EMBODIMENT

The invention will now be explained by referring to the accompanied drawings.

Figure 2:
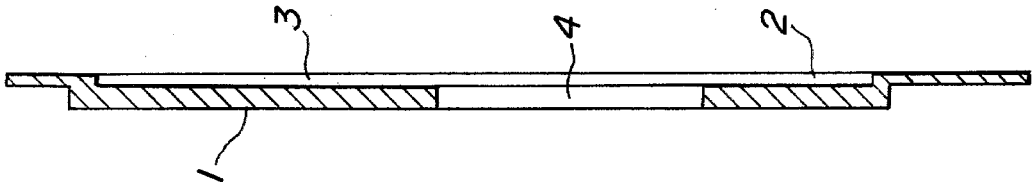
FIG. 2 is an enlarged cross-sectional view taken along line X—X in FIG. 1.
Figure 1:
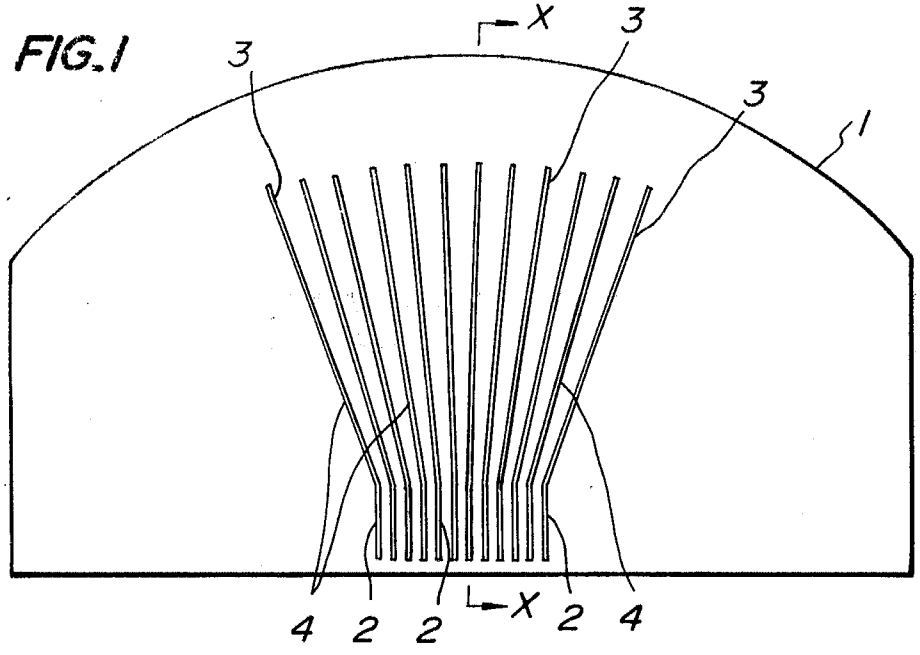
FIG. 1 is a plan view of a lower guide board used in the machine according to the present invention.

The lower guide board 1 according to the present invention is as shown in FIG. 1 and FIG. 2. This lower guide board 1 is made of metal, plastic, wood or the like material and is plate-shaped. On the upper surface thereof there are provided with a number of inserting grooves 3. The grooves 3 have at one end linear portion 2 arranged in parallel and even spaced in a direction of moving of the fabric material (not shown). The other end of the grooves 3 are arranged to extend radially as shown in FIG. 1. At approximate middle portion of each groove 3 terminating with the portion 2, an inserting groove 4 having larger depth as can be better seen from FIG. 2 is provided. The lower guide board 1 is mounted on a working table of a pin-tucking sewing machine (not shown). FIG. 1 shows a case having 12 grooves 3. But this is just illustrating purpose and the invention is not limited by such a particular number. The number may be selected at will for instance between 12 to 24.

Figure 3:
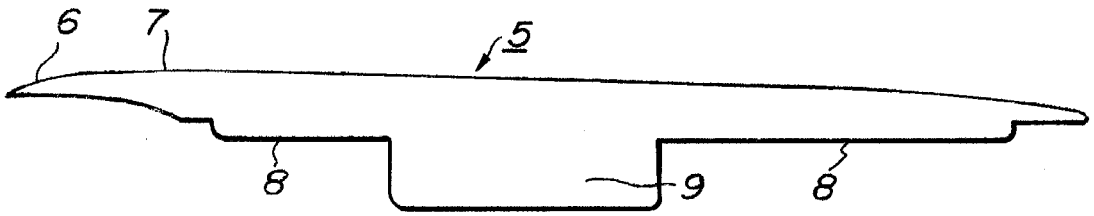
FIG. 3 is also an enlarged side view of a guide member to be used in combination with the guide board shown in FIG. 1 or FIG. 2.

FIG. 3 shows one of the guide members 5. This guide member 5 is made of steel strip and has at one end a straight tucking guide 6 for tucking up working fabric S which will be explained later on. The member 5 has the working head 7 at its upper side and at rear end. The member 5 together with the working 7 is suitably bent in various angles or in straight form according to the location to be inserted into the grooves 3 provided on the lower guide board as shown in FIG. 1. At the lower side of the guide member 5 there is provided with an inserting or coupling edge 8. Around middle of the inserting edge 8 there is provided with an inserting leg 9 having wider depth to be inserted into the inserting groove 4. The guide members 5 are prepared as one set of 12 or 24 blades for instance. Further one or more set of long and/or short ones are provided when desired. By the length of the guide member 5, the width of the tucking is decided.

Figure 4A:
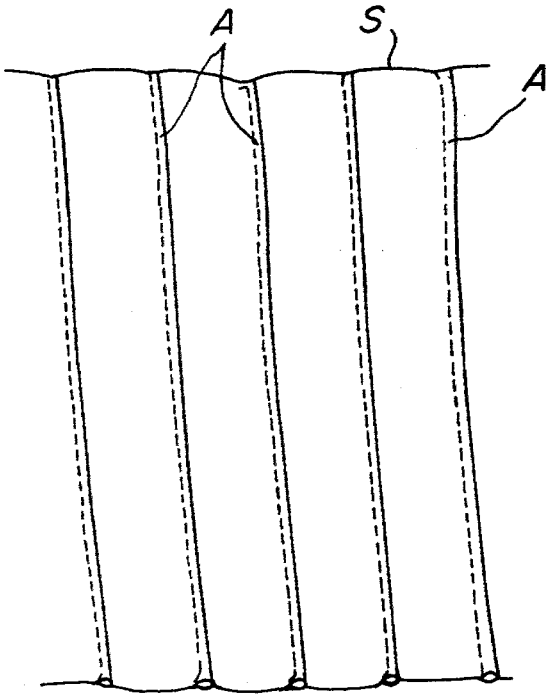
FIGS. 4*a*, 4*b* and 4*c* are the explanatory views for showing different pin-tucking width and spaces for the fabric material obtained by using the pin-tucking sewing machine according to the present invention.
Figure 4B:
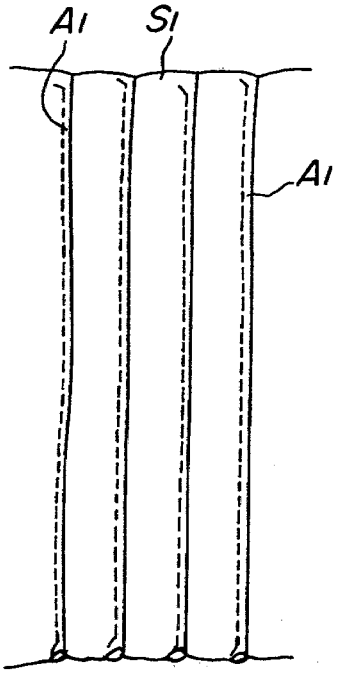
Figure 5:
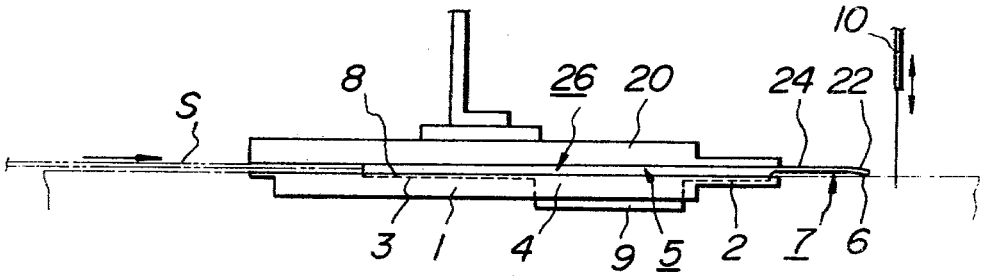
FIG. 5 is a view for showing positional relationship between the upper guide board and the lower guide board in use during operation of the machine.

FIG. 5 shows the manner of use of the guide boards according to the present invention. The upper guide board 20 which is the same as the conventional one is mounted on the pin-tucking sewing machine previously in the usual manner. Against this upper guide board 20, the lower guide board 1 made according to the present invention is arranged oppositely to fit closely. The guide members 26 of the upper guide board 20 and the members 5 are arranged to extend substantially normally from upper and lower surfaces of the boards and nearly parallel each other, so as to allow small clearances therebetween. A fabric material S to be worked out is inserted between the upper guide board 20 and the lower guide board 1 as shown in FIG. 5. The fabric material S is tucked to form fold by the guide members 5 and 26 of the guide boards 1 and 20 respectively as same as the usual pin-tucking machine and is conveyed continuously over the working head of the respective guide members 5 and passing the final tucking guide portions 6 and 22 to form tucking of the required width. Thus tucked fabric material is sewn by a corresponding number of needles 10 operating to move up and down and arranged at outlet of thus tucked fabric material S to form a desired number of pin-tuckings $A_1$ by stitches, such as shown in FIG. 4*b*.

If it is desired to widen the space between the pin-tucking $A_1$ or the stitches, the guide members 5 on the lower guide board 1 may be removed at a suitable interval, for instance, 1 out of 2, or 1 out of 3, or the like, at will. In this case, pin-tucking A having wider space or interval such as shown in FIG. 4*a* can be obtained.

Figure 4C:
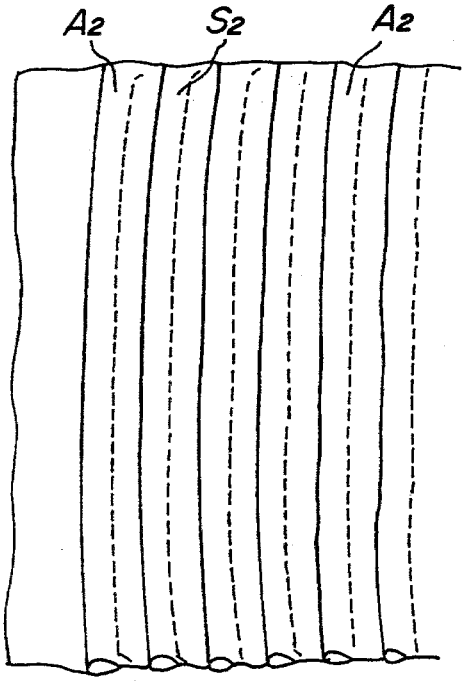
Figure 6:
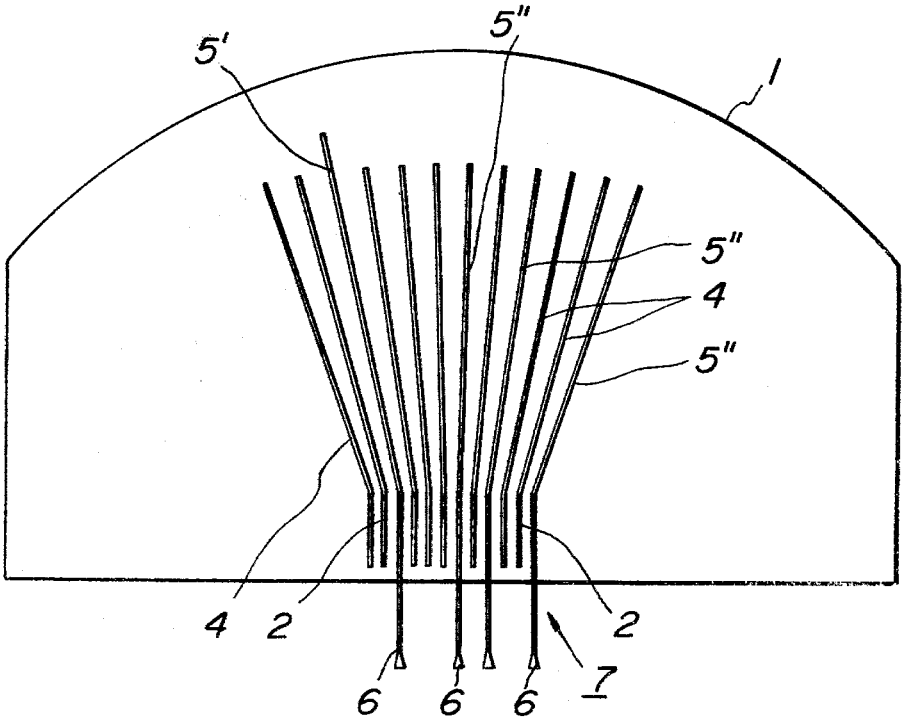
FIG. 6 is a plan view for explaining the mount of guide members of different length on the lower guide board and manner of replacing the same.
Figure 7:
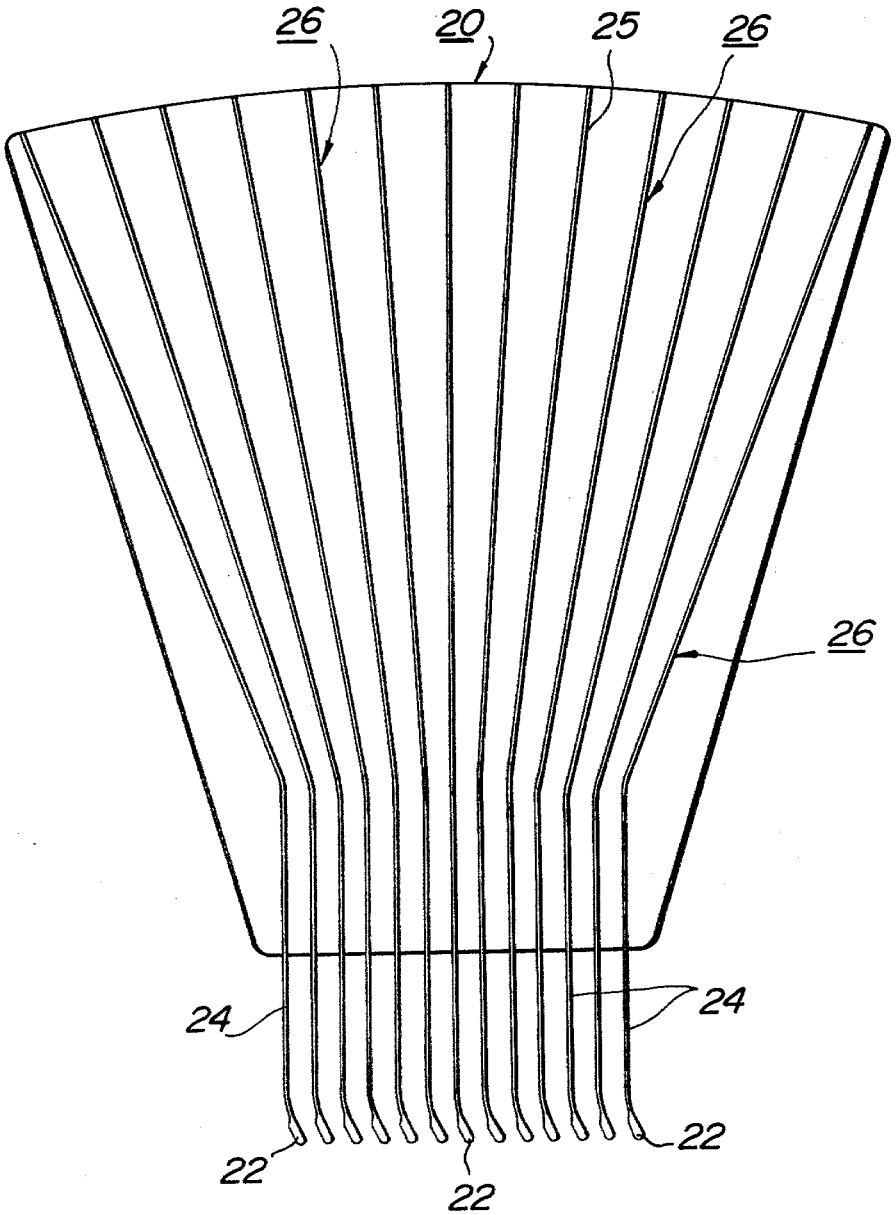
FIG. 7 PRIOR ART
FIG. 7 is a bottom view in an enlarged scale of an upper guide board of the conventional type in which the guide members are fixedly welded thereon.
Figure 8:
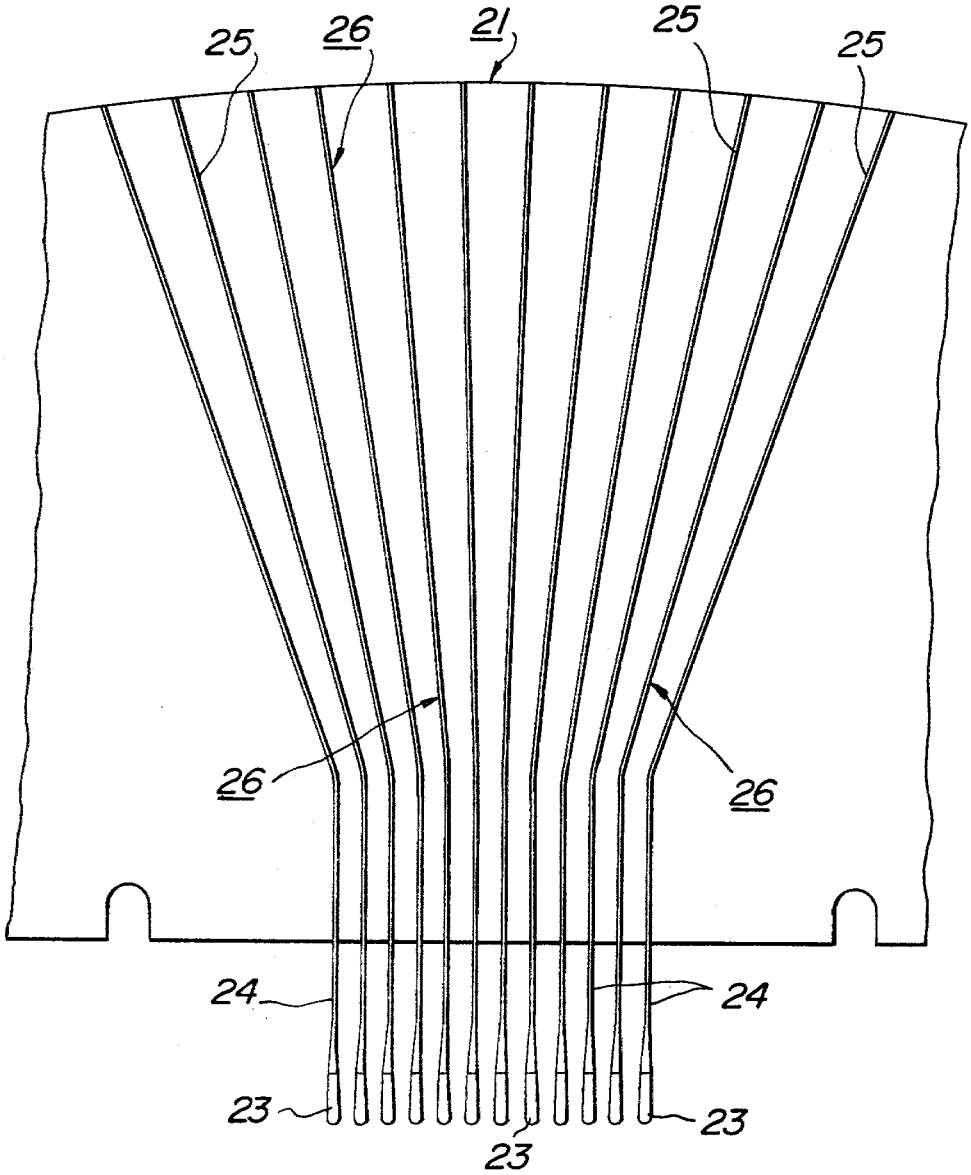
FIG. 8 PRIOR ART
FIG. 8 is a plan view of corresponding lower guide board of the conventional type to be used in combination with the guide board shown in FIG. 7.
Figure 9:
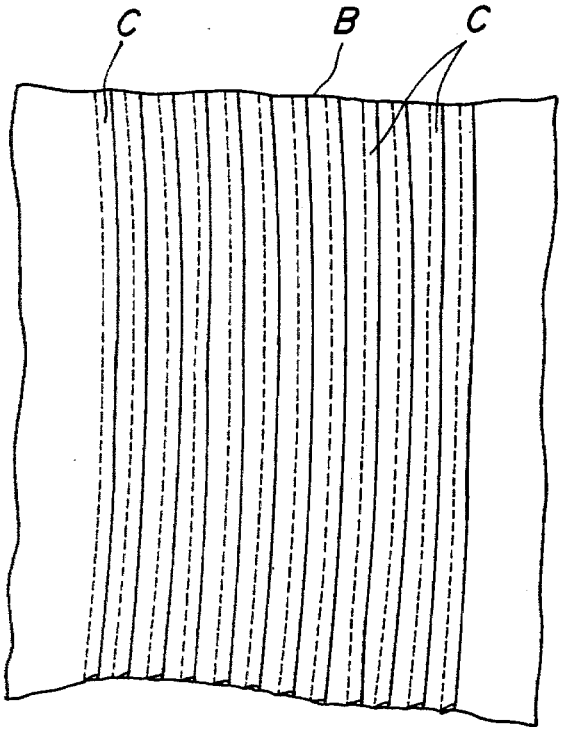
FIG. 9 PRIOR ART
FIG. 9 is an explantory view of a fabric material formed with even spaced pin-tucking by using the conventional pin-tucking machine.

When pin-tucking having wider width is required such as shown pin-tucking $A_2$ in FIG. 4*c*, long guide members 5' such as shown in FIG. 6 may be used where such wide tucking is requested.

Further it is possible to use long guide members 5' and short guide members 5'' in combination on one lower guide board. These members are freely mounted at will by inserting the inserting leg 9 into the mating female groove 4 and also removed at will for instance to form double spacing or so to form variations of the pin-tucking. By this way by using a same sewing machine various decorative stitches on various pin-tucking can be obtained.

According to the present invention, the lower guide board of the pin-tucking machine is arranged to have detachable guide members having an inserting edge and inserting leg to be inserted in the female groove provided on the guide board so that the pin-tucking width and the space can be freely settled by simply removing some of the guide members and/or replacing them with ones having different length. Due to this rather simple replacement, varieties of pin-tucking can be obtained very easily.

This will give quite big advantage compared with the conventional pin-tucking machine in which only one fixed pin-tucking pattern can be obtained since the guide members are all fixed by welding onto the base.

The invention will give further advantage in that undesired guide members on the board can be removed at will so that no folding or gathers to the fabric at undesired location is made. By this, the cotton fabric can be used without any troubles for providing variety of pin-tucking models.

The upper guide board need not be altered so that the invention is very conveniently applied to the existing machine in practice.

What is claimed is:

1. A freely adjustable pin-tucking device for use in a pin-tucking machine comprising a guide board made of metal, plastic, wood, or the like plate shaped material, the guide board is provided with a plurality of even spaced grooves having at rear end even spaced parallel portion extending to radially spaced grooves and deep inserting grooves at middle thereof, and at least one separate set of guide members corresponding to the number of the inserting grooves, the guide members having tucking guides at the rear end and having inserting limbs of different bent angles to match with the radial form of the grooves, the guide members further provided with an inserting leg to be inserted with said inserting grooves to fix the guide members on the guide board in detachable and replaceable manner.

2. A freely adjustable pin-tucking device as claimed in claim 1, wherein one or more set of guide members having different length to form different tucking width are provided and used to match a desired pin-tucking pattern.

* * * * *